US008011308B2

(12) United States Patent
Picchio

(10) Patent No.: US 8,011,308 B2
(45) Date of Patent: Sep. 6, 2011

(54) TELESCOPIC TABLE SUPPORT

(75) Inventor: Cesare Picchio, Como (IT)

(73) Assignee: Unifor S.p.A., Turate (Como) (IT)

( * ) Notice: Subject to any disclaimer, the term of this patent is extended or adjusted under 35 U.S.C. 154(b) by 583 days.

(21) Appl. No.: 11/938,924

(22) Filed: Nov. 13, 2007

(65) Prior Publication Data

US 2008/0121150 A1 May 29, 2008

(30) Foreign Application Priority Data

Nov. 14, 2006 (CA) ..... 2568078

(51) Int. Cl.
*A47B 9/00* (2006.01)
*F16M 11/00* (2006.01)

(52) U.S. Cl. ..... 108/147; 108/144.11; 248/404

(58) Field of Classification Search ..... 108/144.11, 108/146, 147, 147.18, 147.19; 248/333, 248/161, 162.1, 404–414
See application file for complete search history.

(56) References Cited

U.S. PATENT DOCUMENTS

| | | | | | |
|---|---|---|---|---|---|
| 1,919,114 | A | * | 7/1933 | Ley | 403/112 |
| 2,684,159 | A | * | 7/1954 | Oldenkamp | 52/115 |
| 3,521,341 | A | * | 7/1970 | Reinhard et al. | 29/898.066 |
| 3,543,282 | A | * | 11/1970 | Lucien | 108/147 |
| 3,776,500 | A | * | 12/1973 | Foderaro | 248/333 |
| 4,061,304 | A | | 12/1977 | Schattmaier | |
| 4,381,095 | A | | 4/1983 | Kritske | |
| 4,826,128 | A | * | 5/1989 | Schmeller | 248/669 |
| 5,249,881 | A | * | 10/1993 | Austin et al. | 403/378 |
| 5,339,750 | A | * | 8/1994 | Smies | 108/147 |
| 5,385,323 | A | * | 1/1995 | Garelick | 248/161 |
| 5,845,590 | A | * | 12/1998 | Seidl | 108/147 |
| 6,378,816 | B1 | * | 4/2002 | Pfister | 248/161 |
| 2002/0050112 | A1 | * | 5/2002 | Koch et al. | 52/651.07 |
| 2002/0113176 | A1 | * | 8/2002 | Frank | 248/125.8 |
| 2006/0145036 | A1 | * | 7/2006 | Jones et al. | 248/188.5 |

FOREIGN PATENT DOCUMENTS

| | | |
|---|---|---|
| DE | 202 14 378 | 2/2004 |
| EP | 1 270 972 | 1/2003 |
| WO | 2004/041027 | 5/2004 |

OTHER PUBLICATIONS

European Search Report dated May 16, 2008 for European Patent Application No. 2007120452.

* cited by examiner

*Primary Examiner* — Darnell Jayne
*Assistant Examiner* — Timothy M Ayres
(74) *Attorney, Agent, or Firm* — Shoemaker and Mattare

(57) ABSTRACT

A telescopic support is disclosed and has outer and inner leg parts. The outer leg part has: a tubular body defining a longitudinal axis and having an interior passage through which the axis extends centrally. The inner leg part has: a shuttle body part disposed at least partially in the tubular body; and rollers rotably mounted to the shuttle body to support the inner leg part for longitudinal reciprocating movement in the tubular body. The support can be secured to a base and topped with a work-surface defining member to form a height-adjustable table, as also disclosed.

16 Claims, 7 Drawing Sheets

TELESCOPIC TABLE SUPPORT

BACKGROUND OF THE INVENTION

Table or desk tops are often supported by one or more telescopic supports, such that the table or desk top can be raised or lowered to meet the needs of users. A common application is an overbed table with vertical adjustability, as found in hospitals and the like.

Typically, this functionality is met by providing inner and outer tubes separated by, preferably, a self-lubricating bearing material such as polytetrafluorethylene. While this arrangement provides adequate utility, in order to provide a telescopic support which extends and retracts smoothly, the components need to be manufactured with relatively high precision, which entails substantial costs.

U.S. Pat. No. 4,381,095 (Kritske), issued Apr. 26, 1983, employs an alternate structure having four pairs of rollers spring-mounted to the inner tube and adapted to engage the inner surface of the outer tube. The resistance of the rollers to rolling movement is such that a table surface attached to the telescopic structure only raises or lowers upon application of external force. While this structure can provide for smooth operation, this is contingent upon proper functioning of tensioning springs which extend between the paired rollers, which springs can tend to slacken or even break after extended use. As well, since there exists no positive mechanical connection for locking, table tops supported in this manner can lower unintentionally when heavily loaded.

SUMMARY OF THE INVENTION

A telescopic support forms one aspect for the invention. The support comprises an outer leg part and an inner leg part. The outer leg part has: a tubular body defining a longitudinal axis and having an interior passage through which the longitudinal axis extends centrally; and one or more longitudinally-extending splines extending radially, inwardly from the tubular body. The inner leg part has: a shuttle body part disposed at least in part in the tubular body; and rollers rotatably mounted to the shuttle body part to support the inner leg part for longitudinal reciprocating movement in the tubular body. The rollers include, for at least one of said one or more splines, at least one grooved roller having a peripheral groove which receives said spline during said reciprocating movement to constrain said outer and inner leg parts against relative rotation about the longitudinal axis.

A height-adjustable pedestal-style table forms another aspect of the invention and comprises a foot, a telescopic support and a member. The foot defines a base for the table in use. The telescopic support comprises: an outer leg part having a tubular body secured to the foot and extending vertically therefrom in use, said tubular body defining a longitudinal axis and having an interior passage through which the longitudinal axis extends centrally; and one or more longitudinally-extending splines extending radially, inwardly from the tubular body. The inner leg part has: a shuttle body part disposed at least in part in the tubular body; and rollers rotatably mounted to the shuttle body part to support the inner leg part for longitudinal reciprocating movement in the tubular body. The rollers include, for at least one of said one or more splines, at least one grooved roller having a peripheral groove which receives said spline during said reciprocating movement to constrain said outer and inner leg parts against relative rotation about the longitudinal axis. The member is secured to the inner leg part and defines a work surface of the table in use.

A telescopic support forms another aspect of the invention. This support comprises an outer leg part and an inner leg part. The outer leg part has a tubular body defining a longitudinal axis and having an interior passage through which the longitudinal axis extends centrally. The inner leg part has a shuttle body part and rollers. The shuttle body part is disposed at least in part in the tubular body. The rollers are rotatably mounted to the shuttle body part to support the inner leg part for longitudinal reciprocating movement in the tubular body. The fit between the outer leg part and the inner leg part defines a negative allowance and the tubular body deforms elastically during said reciprocating movement to accommodate such negative allowance.

The invention permits the relatively inexpensive construction of relatively robust desks and tables that can be relatively smoothly raised and lowered. Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinbelow.

DETAILED DESCRIPTION OF THE PREFERRED EMBODIMENT

Figure 1:
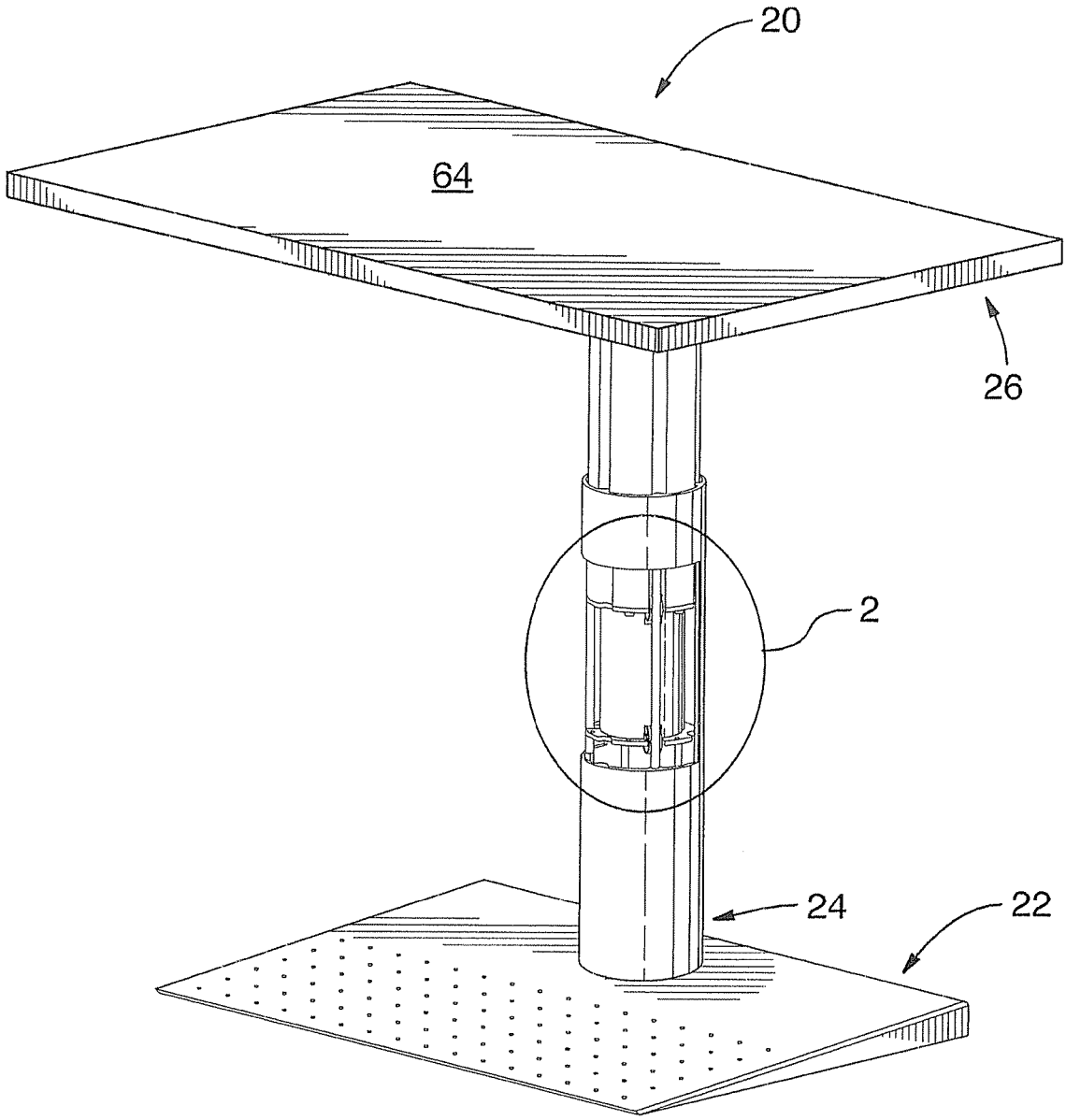
FIG. 1 is a perspective, partially cut-away view of a telescopic support constructed according to a preferred embodiment of the invention in use in a height-adjustable, pedestal-style desk which forms another preferred embodiment of the invention.
Figure 2:
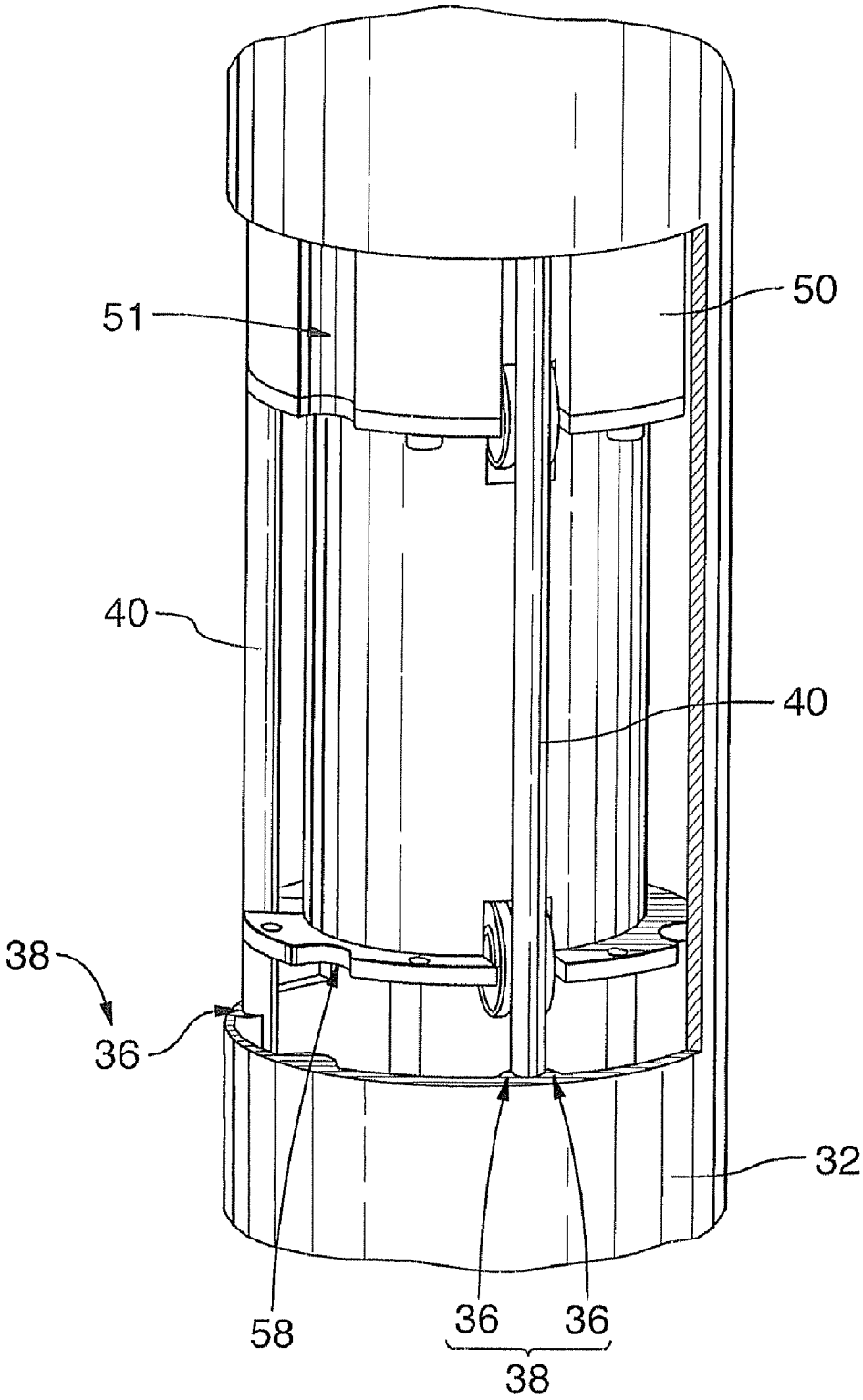
FIG. 2 is an enlarged view of encircled area 2 in FIG. 1.

A height-adjustable pedestal-style table or desk constructed according to a preferred embodiment of the invention and designated with general reference numeral 20 is illustrated in partially-cut away perspective view in FIG. 1 and will be seen to comprise, generally, a foot 22, a telescopic support 24 and a desk or table top member 26.

The telescopic support 24, which will be described initially, is shown in exploded view in FIG. 3 and will be seen to comprise an outer leg part 28 and an inner leg part 30.

The outer leg part 28 has an extruded aluminum tubular body 32 which defines a longitudinal axis X-X and has an interior passage 34 through which the longitudinal axis X-X extends centrally. The body 32 is generally thin-shelled, but includes a plurality of longitudinally-extending stiffening ribs 36,36', best seen in FIG. 8.

Six of these ribs 36 are disposed in three pairs 38, wherein the paired ribs 36 are closely-spaced to one another, the three pairs 38 being equally-spaced around the interior passage 34. The remaining ribs 36' are somewhat larger in cross-section than ribs 36.

Figure 7:
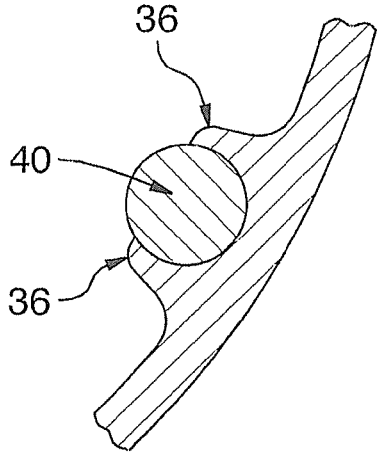
FIG. 7 is a view along arrow A of FIG. 4.

The outer leg part 28 also has at least one, specifically three, longitudinally-extending splines 40 extending radially, inwardly from the tubular body 32. The splines 40 are formed separately from the tubular body 32 and take the form of steel rods, each snap-fit between the ribs 36 of a respective pair 38, as shown in FIG. 7, wherein the ribs 36 of each pair 38 will be seen to define a channel of semi-circular cross-section which receive in tight-fitting relation the respective spline rods 40.

The inner leg part 30 has a shuttle body part 42, rollers 44,46 and a fluted body part 50.

Figure 5:
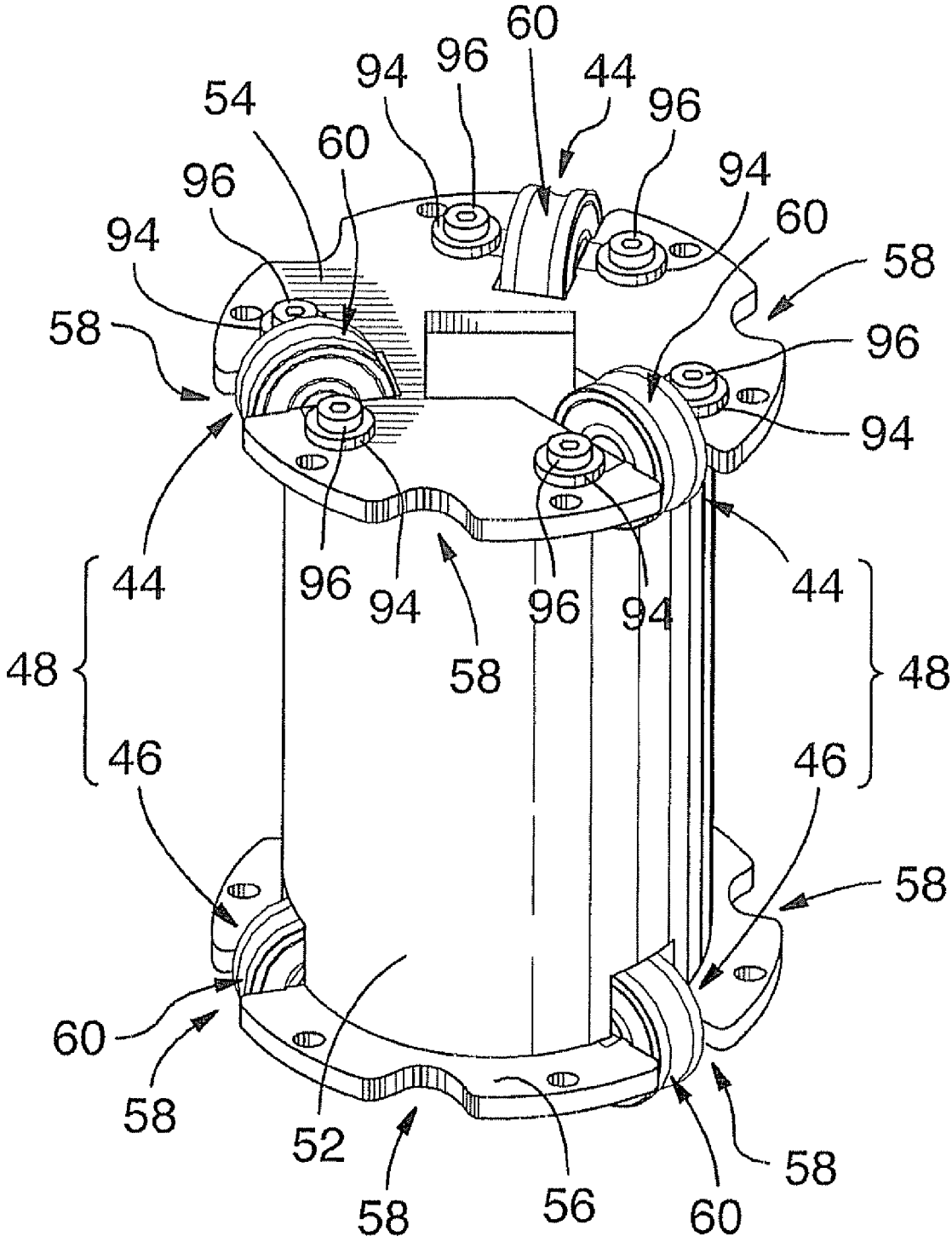
FIG. 5 is an enlarged view of encircled area 5 in FIG. 3.

The shuttle body part 42 is disposed at least in part in the tubular body 32 and, as best seen in FIG. 5, has a substantially cylindrical center portion 52 and notched plates 54,56 secured to the center portion 52 and forming longitudinally-spaced upper and lower ends of the shuffle body part 42 in use.

Figure 6:
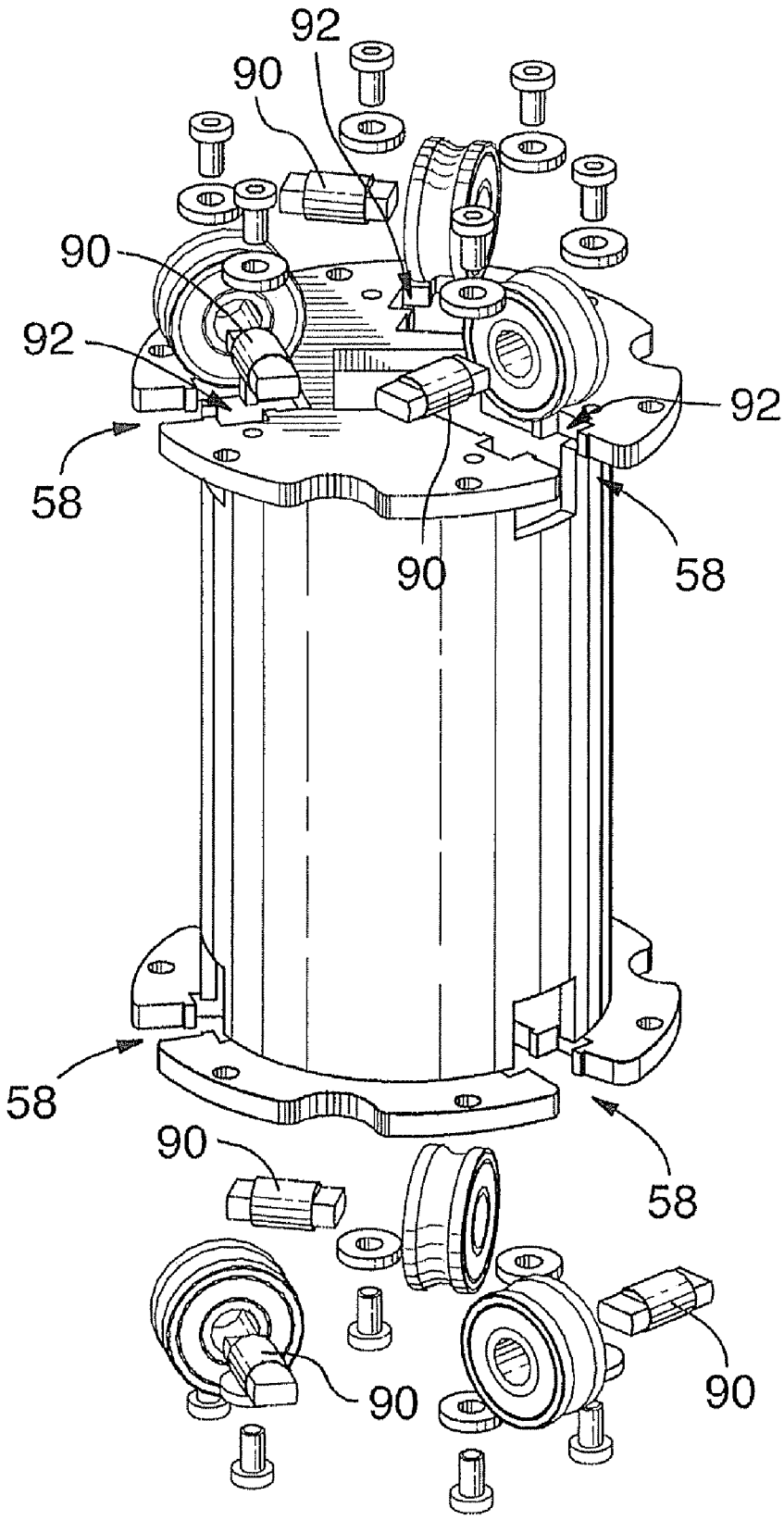
FIG. 6 is an exploded view of the structure of FIG. 5.
Figure 8:
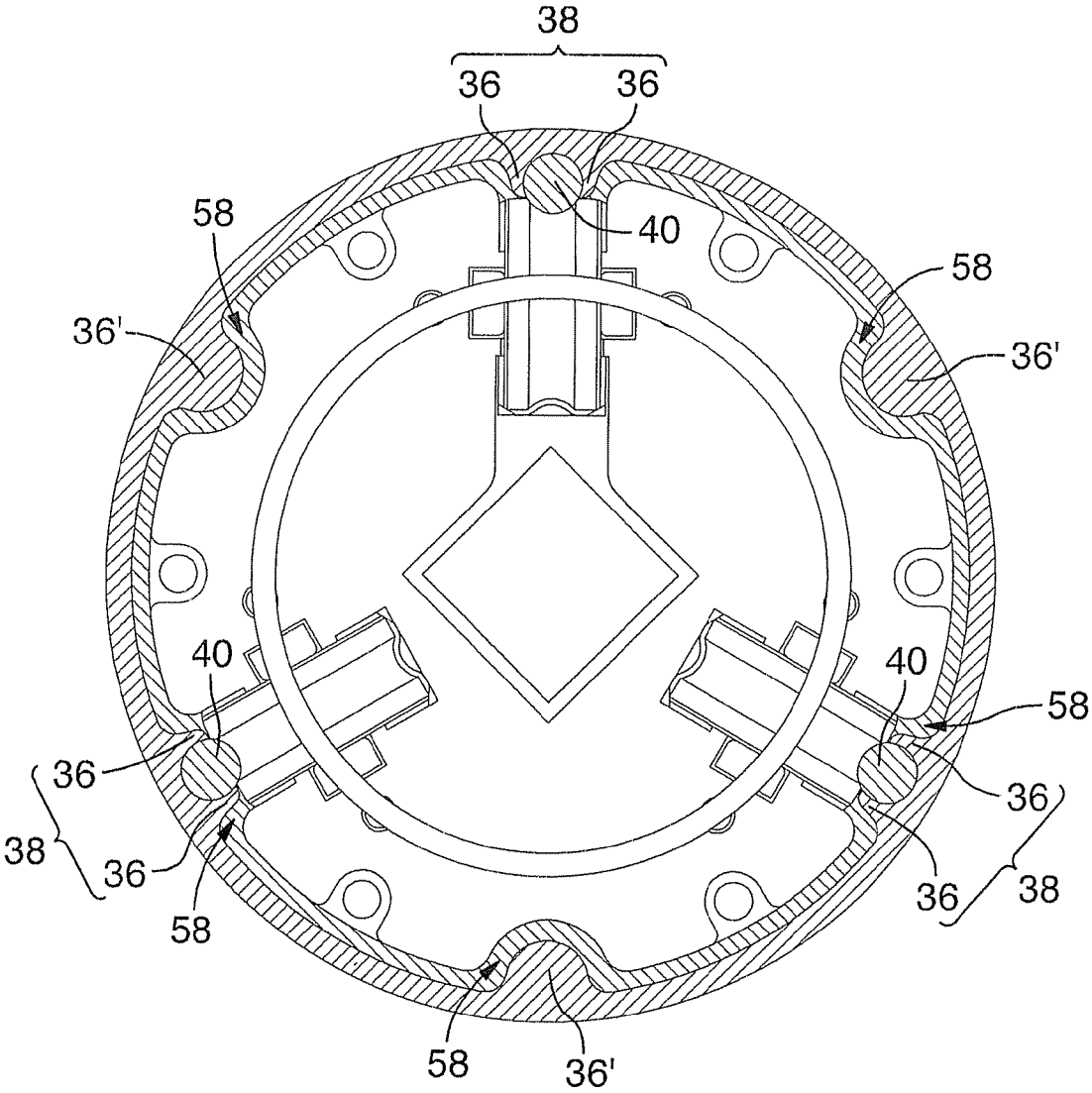
FIG. 8 is a cross-sectional view along axis X-X at elevation B of FIG. 1.

The rollers 44,46 are steel, are six in number and are arranged in three pairs 48. In each pair 48, the rollers 44,46 are longitudinally-spaced from one another, each at a respective end of the shuttle body part 42 and fitted in a respective notch 58 defined in the notched plate 54,56 defining said end. The three pairs 48 are equally spaced around the shuttle body part 42. Each of the rollers 44,46 is a grooved roller having a groove 60 in receipt of a respective spline 40, as shown in FIGS. 1 and 8, and is mounted to the shuttle body part 42 for rotation by means of an axle 90 having a ball bearing. Each axle 90 has an associated socket 92 in which it is received and captured by a pair of washers 94 and bolts 96, as indicated in FIGS. 5 and 6.

The fluted body part 50 is an aluminum extruded member secured by bolts or screws 64 to the upper notched plate 54 of the shuttle body part 42 so as to extend longitudinally therefrom. The fluted body part 50 has a plurality of longitudinally-extending external grooves 51.

When the telescopic support 24 is in use, the rollers 44,46 roll along the splines 40, to permit telescopic longitudinal reciprocating movement of the outer leg part 28 and the inner leg part 30. The engagement between the grooves 60 and splines 40 both constrains the outer 28 and inner 30 leg parts against relative rotation about the longitudinal axis X-X and provides for longitudinal alignment of the outer 28 and inner 30 leg parts, to permit constrained reciprocating relative movement parallel to the longitudinal axis X-X.

The fit between the inner leg part 30 and outer body part 28 is of a negative allowance nature, that is, the interior dimension of the tubular body 32 and splines 40 is smaller than the exterior dimensions of the shuttle body part 42 and rollers 44,46. To accommodate this negative fit, the tubular body 32 elastically deforms to receive the inner leg part 30. This arrangement permits smooth reciprocating motion, notwithstanding minor manufacturing imperfections that may exist. Further assisting this smooth reciprocating motion is a sliding fit between at least one of rollers 44 and its respective axle 90 and at least one of rollers 46 and its respective axle; such rollers 44,46 can slide ±4 mm along their rotational axes to accommodate extrusion imperfections, etc. The splines 40, as well as those stiffening ribs 36' that do not form part of the pairs 38, traverse the external grooves 51 in spaced relation when the fluted body part 50 moves within the tubular body 32, and similarly traverse notches 58 in upper and lower plates 54,54. The accommodation provided by flexure of the tubular body 32 permits the various components to be manufactured relatively inexpensively, i.e. without the need for unduly high precision, with confidence that the product will still reciprocate relatively smoothly in use. The structure is also relatively robust.

In the application shown in FIG. 1, the foot 22 forms a base for the table 20, the telescopic support 24, specifically, the tubular body 32, is fitted to the foot 22 to extend vertically-upwardly therefrom, and the table top member 26 is fitted to the inner leg part 28 to define a substantially horizontal, planar work surface 64, the elevation of said surface 64 being amenable to adjustment via extension or retraction of the telescopic support 24 associated with said reciprocating movement of the inner 28 and outer 30 leg parts.

Figure 3:
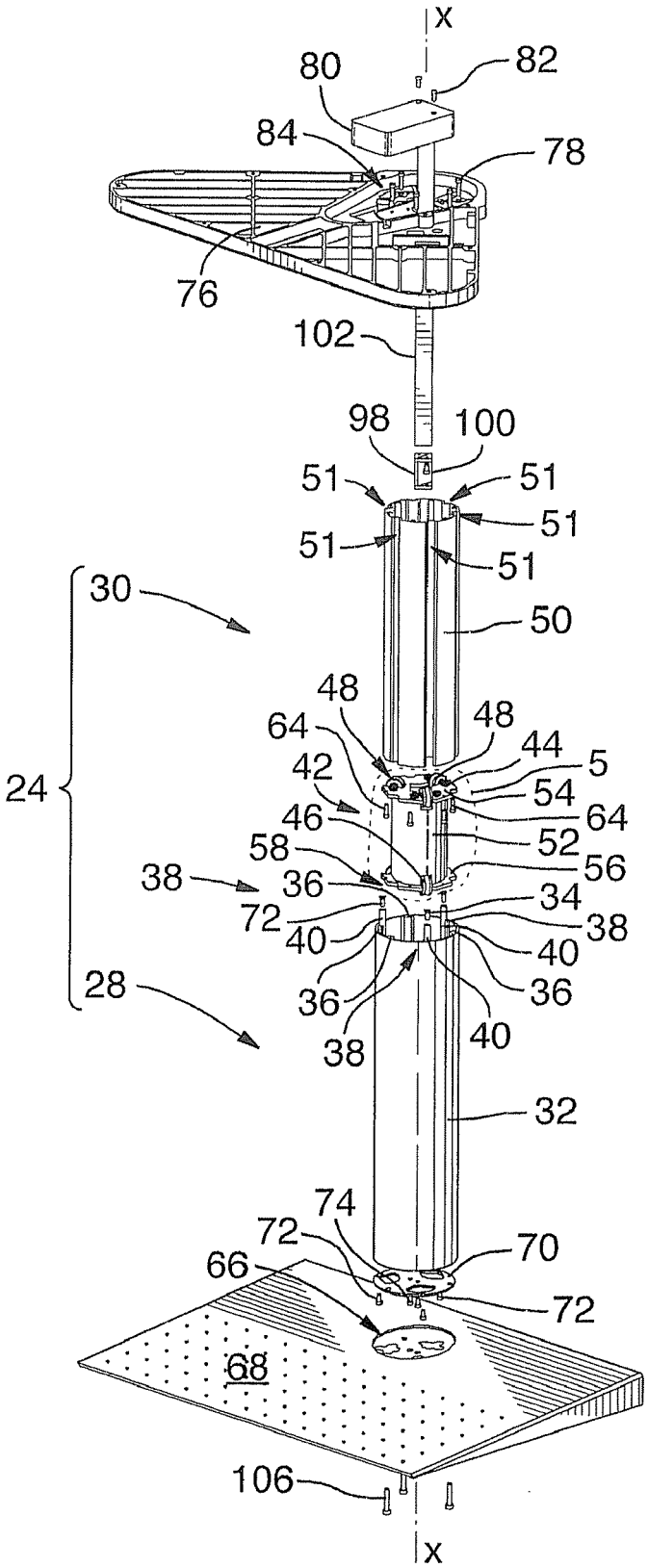
FIG. 3 is an exploded, perspective view of the desk of FIG. 1, with the desk top removed, for clarity.
Figure 4:
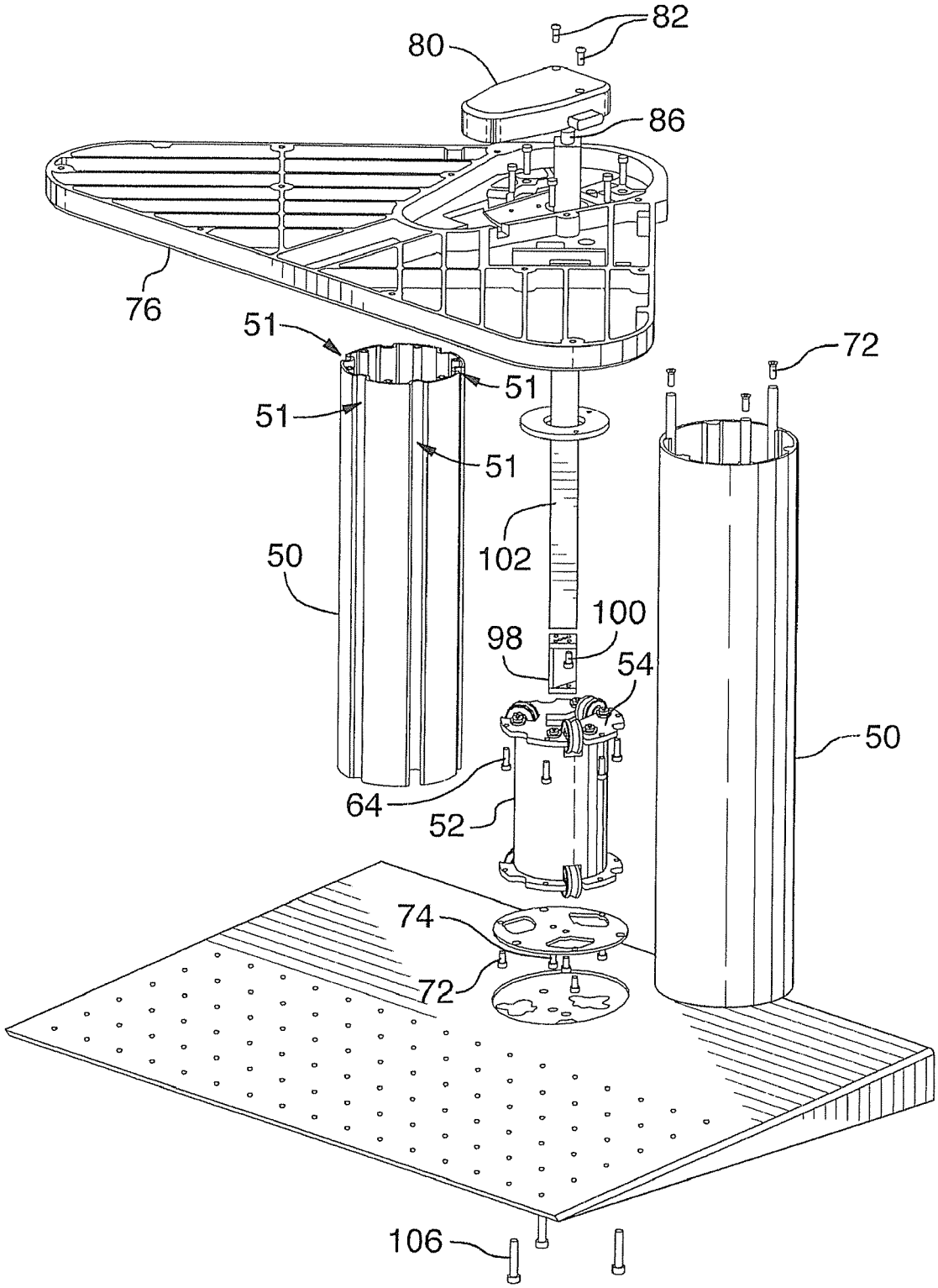
FIG. 4 is a view similar to FIG. 3, with some parts repositioned.

As best seen in FIG. 3, in the preferred embodiment shown, the foot 22 is a substantially wedge-shaped member which defines a socket 66 for receiving the lower end of the telescopic support 24 and has an inclined upper surface 68 that is textured for grip. A bottom plate 70 is secured to the lower end of the tubular body 32 by bolts 72 which engage the lower ends of spline rods 40. Bolts 72 are also fitted to the upper ends of spline rods 40, such that the spline rods 40 are locked as against longitudinal movement relative to the outer body part 32. To the bottom plate 70 is secured, by bolts 74, a riser bracket 98. In turn, bracket 98 is secured by bolts 100 to a drive nut riser 102. Bolts 106 extend through the foot 22 and bottom plate 70 to secure tubular body 32 to foot 22.

The table top member 26 is secured to the upper end of the fluted body 50. Such securement in the application shown is provided by an intermediate bracket 76, which is secured by bolts 78 to the upper end of the fluted body 50, and to which the table top 26 is secured by screws (not shown).

An electrical motor 80 is secured by bolts 82 in a recess 84 of the intermediate bracket 76, and has drivably coupled thereto a threaded driveshaft 86 which, in use, extends into and is threadably received by the drive nut riser 102, such that rotation of the driveshaft 86 causes extension and retraction of the telescopic support 24, and cessation of rotation forms a mechanical lock against extension and retraction.

While only a single preferred embodiment of the telescopic support and a single preferred embodiment of the pedestal table of desk are described herein, it will be understood that various changes may be made thereto.

For example, whereas only three longitudinally-spaced pair of rollers are shown, greater numbers of longitudinally-spaced rollers could be provided. For example, four pairs of longitudinally-spaced rollers could be provided, each pair being spaced 90° from the other.

The splines could be formed integrally, could take the form of tubes rather than rods, could have cross-sections other than round, and could be secured by welding, adhesive, rivets, screws, etc.

Further, the outer leg part need not be extruded, nor of steel and could be formed, by way of example, by blow or rotationally-molded plastics, or by sonically-welded injection molded components.

Additionally, the inner leg part need not be hollow, nor fluted, and mechanisms other than threaded shafts could be utilized for vertical adjustment and locking.

Moreover, whereas in the table shown, the outer leg part is secured to the base, it should be appreciated that the telescopic support could be upended in use, such that the inner leg part was secured to the base.

Yet further, whereas the structure described shows splines on the interior of the outer leg part and rollers on the exterior of the inner leg part, this arrangement could be reversed, such that the splines were formed on the exterior of an inner leg part and the rollers were provided on the interior of an outer leg part. In this arrangement, accommodation of the negative fit could be provided by elastic deformation of either or both of the inner and outer leg parts.

In view of the above, the invention should be understood to be limited only by the claims appended hereto, purposively construed.

The invention claimed is:

1. A telescopic support for a table defining a work surface, said support comprising:

an outer leg part having a tubular body defining a longitudinal axis and having an interior passage through which the longitudinal axis extends centrally, said tubular body having vertically extending ribs; and one or more longitudinally-extending splines extending radially, inwardly from the tubular body; and an inner leg part having:

a shuttle body part and a fluted body part separable from said shuttle body part, both said parts being disposed at least in part in the tubular body said fluted body part being geometrically coupled to the tubular body of the outer leg part with notches fitted on said ribs and having a substantially cylindrical center portion and notched plates secured to either end of the center portion and forming longitudinally-spaced upper and lower ends of the shuttle body part; and rollers rotatably mounted to the shuttle body part by means of an axle having a ball bearing to support the inner leg part for longitudinal reciprocating movement in the tubular body, in which the rollers are longitudinally spaced from one another, each at a respective end of the shuttle body part and disposed in a respective notched plate defining said end, wherein said rollers include, for at least one of said one or more splines, at least one grooved roller having a peripheral groove which receives said spline during said reciprocating movement to constrain said outer and inner leg parts against relative rotation about the longitudinal axis, the interior dimension of the tubular body and splines is smaller than the exterior dimension of the shuttle body part and rollers so that there is an interference fit between the inner leg part and the tubular body of the outer leg part and there is a sliding fit between at least one of the rollers and its respective axle to permit smooth reciprocating motion.

2. A support according to claim 1, wherein the one or more splines consists of three splines, equally-spaced from one another around an inner periphery of the tubular body.

3. A support according to claim 1, wherein the tubular body is an extruded member.

4. A support according to claim 3, wherein the tubular body is aluminum.

5. A support according to claim 2, wherein the splines are formed separately from the tubular body and snap-fit secured thereto in the outer leg part.

6. A support according to claim 5, wherein the splines are steel rods of round cross-section.

7. A support according to claim 2, wherein the inner leg part further comprises a fluted body part rigidly secured to the shuttle body part and extending longitudinally therefrom, the fluted body part having longitudinally-extending external grooves which the splines traverse in spaced-relation when the fluted body moves within the tubular body during said longitudinal reciprocating movement.

8. A support according to claim 7, wherein the fluted body is an extruded member.

9. A support according to claim 8, wherein the fluted body is aluminum.

10. A support according to claim 1, wherein said rollers include, for at least one of said one or more splines, a pair of the grooved rollers, longitudinally-spaced from one another, to provide for longitudinal alignment of the outer and inner leg parts during said reciprocating movement.

11. A support according to claim 3, wherein said rollers include three pairs of grooved rollers, the rollers forming each pair being longitudinally spaced from one another.

12. A support according to claim 1, further comprising:

a longitudinally extending threaded driveshaft rotatably mounted to the inner leg part; and a threaded receiver rigidly mounted to the outer leg part and in threaded receipt of the driveshaft to provide for said reciprocating movement of the outer and inner leg parts upon rotation of the driveshaft.

13. A support according to claim 12, further comprising:

a motor coupled to said driveshaft to provide for said rotation thereof.

14. The support of claim 1, wherein the shuttle body part comprises a center section and upper and lower notched plates fixed to respective ends of the center section, and the fluted body part is an aluminum extruded member secured by bolts or screws to the upper notched plate of the shuttle body part so as to extend longitudinally therefrom, and has a plurality of longitudinally-extending external grooves.

15. The support of claim 14, wherein each said notched plate has plural recesses in which respective ones of said rollers are disposed, and plural sockets for receiving respective ends of the axles upon which the rollers are mounted, and fasteners for retaining the axles in said sockets.

16. A height-adjustable pedestal-style table comprising:

a foot defining a base for the table in use;

a telescopic support comprising:

an outer leg part having:

a tubular body secured to the foot and defining ribs extending vertically in use, said tubular body defining a longitudinal axis and having an interior passage through which the longitudinal axis extends centrally; and one or more longitudinally extending splines extending radially, inwardly from the tubular body; and an inner leg part having: a shuttle body part and a fluted body part separable from said shuttle body part, both parts being disposed at least in part in the tubular body;

said fluted body part being geometrically coupled to the tubular body of the outer leg part with notches fitted on said ribs; and rollers rotatably mounted to the shuttle body part to support the inner leg part for longitudinal reciprocating movement in the tubular body, wherein said rollers include, for at least one of said one or more splines, at least one grooved roller having a peripheral groove which receives said spline during said reciprocating movement to constrain said outer and inner leg parts against relative rotation about the longitudinal axis; and a member secured to the inner leg part and defining a work surface of the table in use, wherein the interior dimension of the tubular body and splines is smaller than the exterior dimension of the shuttle body part and rollers so that there is an interference fit between the inner leg part and the tubular body of the outer leg part and there is a sliding fit between at least one of the rollers and its respective axle to permit smooth reciprocating motion.

* * * * *